US006962121B1

(12) United States Patent
Kuklinski

(10) Patent No.: US 6,962,121 B1
(45) Date of Patent: Nov. 8, 2005

(54) BOILING HEAT TRANSFER TORPEDO

(75) Inventor: Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1 day.

(21) Appl. No.: 10/911,749

(22) Filed: Jul. 30, 2004

(51) Int. Cl.[7] ..... B63B 1/34
(52) U.S. Cl. ..... 114/67 A; 102/399
(58) Field of Search ..... 114/67 A; 102/399

(56) References Cited

U.S. PATENT DOCUMENTS 3,075,489 A * 1/1963 Eichenberger ..... 114/67 A
3,205,846 A * 9/1965 Lang ..... 114/67 A
3,392,693 A * 7/1968 Hulsebos et al. ..... 114/20.1
3,435,796 A * 4/1969 Merrill ..... 114/67 A
3,455,266 A * 7/1969 Giles ..... 114/67 A
6,684,801 B1 * 2/2004 Kuklinski ..... 114/67 A

* cited by examiner

*Primary Examiner*—Jesus D. Sotelo
(74) *Attorney, Agent, or Firm*—James M. Kasischke; Jean-Paul A. Nasser; Michael P. Stanley

(57) ABSTRACT

A system has a source of gas venting gas at a nose portion of the vehicle to create a gas/vapor cavity on the nose portion and an adjacent hull of the vehicle. A thermal engine propelling the vehicle through ambient water creates waste heat for heating the hull to raise the temperature of the gas/vapor cavity extending over it. A pump aft on the vehicle recirculates a portion of the gas/vapor cavity as recirculated gas to the nose portion. The velocity of the recirculated gas of the gas/vapor cavity is controlled by the pump to be virtually the same as the relative flow rate of the ambient water along an interface boundary between the gas/vapor cavity and the ambient water.

17 Claims, 3 Drawing Sheets

BOILING HEAT TRANSFER TORPEDO

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to a system for increasing the performance of undersea vehicles. More particularly, this invention relates to a system for a torpedo that creates and maintains a vapor cavity to reduce drag and increase propulsion efficiency.

(2) Description of the Prior Art

Undersea vehicles, such as torpedoes, are restricted in speed and range by the size of their power plants and amount of fuel they carry. Another significant factor limiting performance is the amount of drag created as the torpedoes go through water to their targets. Considerable research by designers of torpedoes to reduce drag is ongoing, but acceptable results are still being sought.

Thus, in accordance with this inventive concept, a need has been recognized in the state of the art a system to create and maintain a vapor cavity on the hull of an underwater torpedo to reduce drag and thereby increase system efficiency.

OBJECTS AND SUMMARY OF THE INVENTION

The first object of the invention is to provide a system for reducing drag and increasing propulsion efficiency of an undersea vehicle, such as a torpedo.

Another object is to provide a system for reducing drag and increasing propulsion efficiency of a torpedo with a gas/vapor cavity created and maintained during a torpedo run.

Another object is to provide a system for reducing drag and increasing propulsion efficiency on a torpedo using ventilation gas, gas recycling, and waste heat from a propulsion engine to create and maintain a controllable, stable gas/vapor cavity.

Another object is to provide a system for a torpedo that stores waste heat on-board a torpedo to sustain a stable gas/vapor cavity around the hull.

Another object is to provide a system for reducing drag and increasing propulsion efficiency on a torpedo using supercavitation to control surface thermal properties.

Another object is to provide a system for reducing drag, increasing propulsion efficiency, and isolating a sonar array from self-generated noise of the torpedo.

Another object is to provide a system for reducing drag and increasing propulsion efficiency on a torpedo and having the ability to cycle between low speed and high-speed vapor cavity operation during a single torpedo run.

These and other objects of the invention will become more readily apparent from the ensuing specification when taken in conjunction with the appended claims.

Accordingly, the present invention is a system to create and maintain a gas vapor cavity on the surface of an undersea vehicle, such as a torpedo. A source of gas vents gas at a nose portion of the torpedo. The vented gas creates a gas/vapor cavity enveloping the nose portion and an adjacent outer hull of the torpedo. A thermal engine propels the torpedo through ambient water and creates waste heat as a by-product. The engine is disposed with respect to the outer hull of the torpedo for heating the outer hull with the waste heat to raise the temperature of the gas/vapor cavity extending over the outer hull. A pump aft on the torpedo recirculates a portion of the gas/vapor cavity as recirculated gas to the nose portion from the aft portion. The velocity is controlled by the pump to be virtually the same as the relative flow rate of the ambient water about the torpedo. The controlled velocity of the recirculated gas maintains the stability of the gas/vapor cavity along an interface boundary between the gas/vapor cavity and the ambient water. A cavitator plate is located on the torpedo forward of the gas venting source and a conical deflector is located behind the cavitator plate and forward of the gas venting source for radially deflecting the vented gas to assure that the gas/vapor cavity covers the nose portion and the outer hull.

BRIEF DESCRIPTION OF THE DRAWINGS

A more complete understanding of the invention and many of the attendant advantages thereto will be readily appreciated as it becomes better understood by reference to the following detailed description when considered in conjunction with the accompanying drawings wherein like reference numerals refer to like parts and wherein.

DESCRIPTION OF THE PREFERRED EMBODIMENTS

Figure 1:
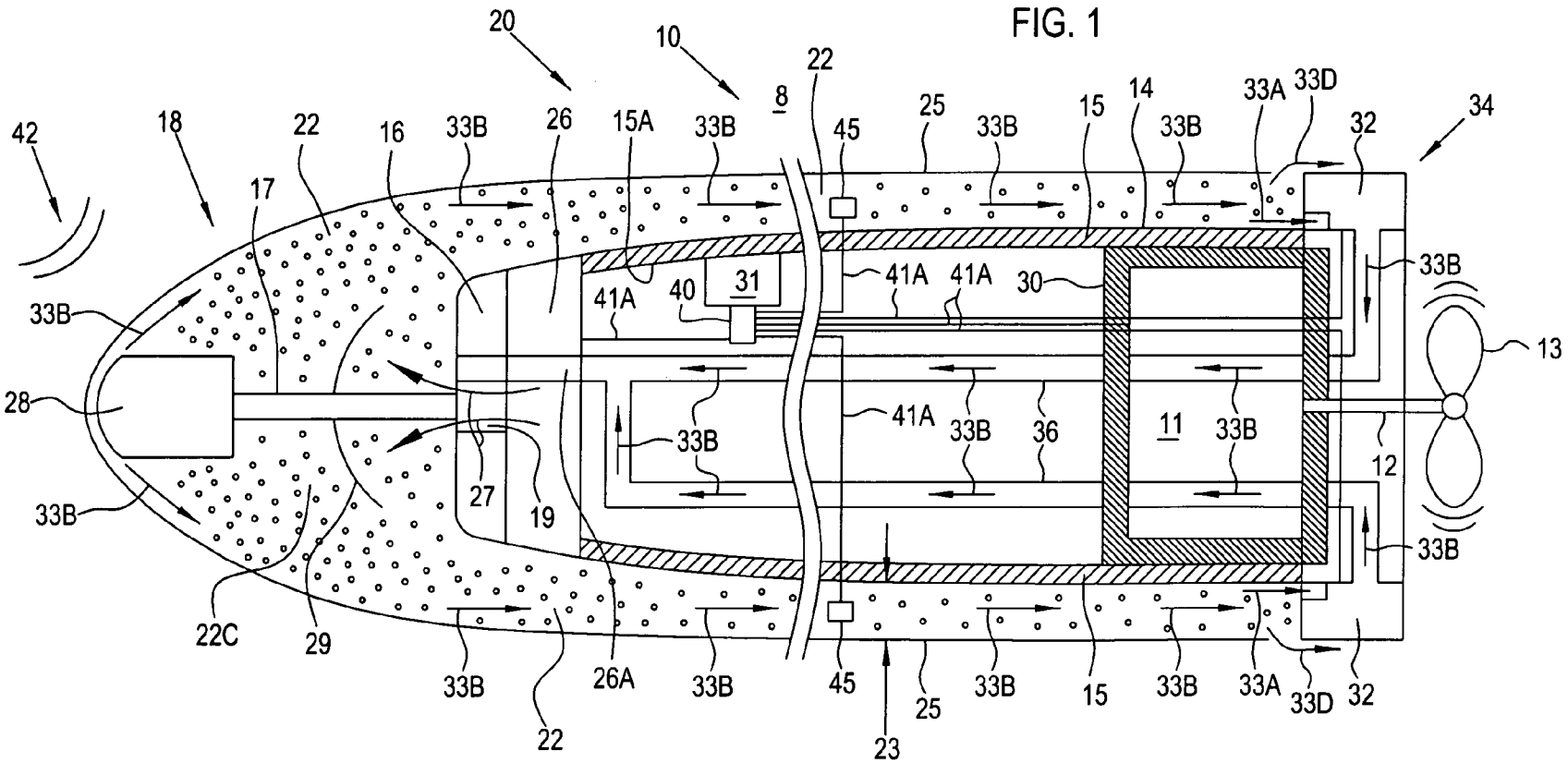
FIG. 1 is a schematic showing of a preferred embodiment of the system of the invention.

Referring to FIG. 1 of the drawings, a torpedo 10 has an internal thermal engine or motor 11 connected by a shaft 12 to one or more propellers 13 to propel torpedo 10 through ambient water 8 to a distant target. Engine 11 can be any of many well known proven designs that creates sufficient power to rotate interconnected propellers 13 for propulsive thrust and generates considerable amounts of waste heat as a by-product of operation. Engine 11 could also be a rocket or jet engine that produces significant waste heat. This waste heat is effectively coupled by heat transfer-ventilation system of the invention to an outer surface 14 of hull 15 of torpedo 10 to help create a cavity 22 to reduce drag between torpedo 10 and ambient water 8.

Figure 2:
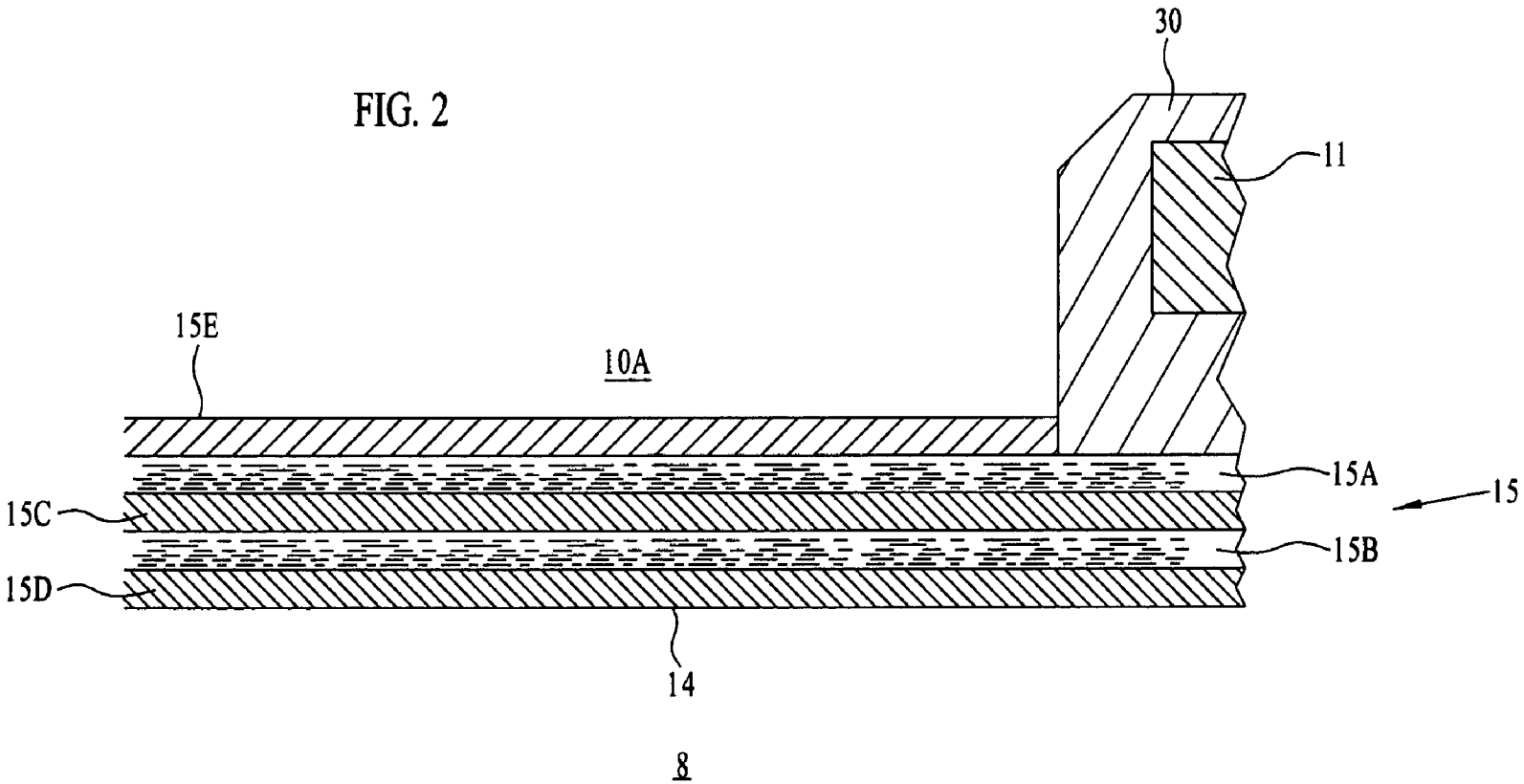
FIG. 2 schematically shows the constituents of a portion of the hull of the torpedo.

Referring also to FIG. 2, hull 15 can be made of layers 15A, 15B, of high heat capacity liquid or metal that are sandwiched within matrix layers 15C, 15D of highly conductive material. Hull 15 has an insulating layer 15E for thermal shielding of structural support elements and other components (schematically generally designated as 10A inside of hull 15 of torpedo 10).

In accordance with this invention, heat is added to surface 14 (such as by conduction, convection, and/or radiation of waste heat from engine 11 to hull surface 14 via layers 15A, 15B, 15C, and 15D). The temperature of surface 14 rises causing a normal sequence of natural convection and then sub-cooled boiling. The term sub-cooled boiling is meant to include the transition from the liquid state of water 8 at 100° C. along surface 14 to the gaseous state of water (steam) at 100° C. along surface 14. Since significant amounts of energy are needed to effect this transition for a given amount of water along surface 14, the heat transfer coefficient at surface 14 can increase dramatically as surface 14 experiences pool boiling. This increase in heat transfer coefficient makes it increasingly difficult to raise the temperature of water 8 at surface 14 sufficiently for pool boiling over the entire surface 14 since inordinate amounts of heat must be introduced to surface 14.

At some point, however, the boiling on surface 14 by waste heat from engine 11 can be made intense enough to produce large amounts of bubbles at surface 14. The layer of bubbles causes a decrease in the effective transfer of heat to ambient water 8, and the temperature at surface 14 then rises rapidly. This rise in temperature continues until surface 14 is entirely covered with a blanket of vaporized steam in cavity 22. From this point of time on, relatively low amounts of heat from engine 11 are needed to maintain gas/vapor cavity 22.

Even at significant depth, less than half of the waste heat typically produced by a conventional open cycle torpedo engine is sufficient to maintain gas/vapor in cavity 22. Having gas/vapor cavity 22 in place on surface 14 virtually eliminates frictional drag over torpedo 10 (or other underwater vehicle surfaces) as torpedo 10 is propelled forward through water 8. Consequently, drag is greatly decreased and/or pressure fluctuations associated with self-noise are eliminated.

In accordance with this invention, two major technical hurdles have been identified and overcome by heat transfer-ventilation system 20 of the invention to create and maintain gas/vapor in cavity 22. The first major technical hurdle overcome by system 20 was providing sufficient energy to transition portions of ambient water 8 from the liquid state at 100° C. along surface 14 to the gaseous state (steam) at 100° C. as gas/vapor cavity 22 along surface 14, and then maintaining the stability of gas/vapor cavity 22 on surface 14 of hull 15 in terms of thickness and temperature at different pressures. While there is sufficient waste heat to sustain gas/vapor cavity 22 of boiling water (steam) on surface 14 of hull of typical torpedo 10, there is not sufficient waste heat to reliably create gas/vapor cavity 22 since the amount of waste heat required to nucleate boiling from liquid water to gaseous steam of gas/vapor cavity 22 requires about an order of magnitude increase in waste heat that may not be attainable by engine 11 alone. In other words, it was found that the size of engine 11 might need to be increased to a prohibitive size for torpedo-10 to produce this amount of heat.

This problem is overcome by the supplementary ventilation system which keeps the heat transfer of surface 14 of hull 15 relatively low while it is heated to a temperature sufficient to maintain boiling within gas/vapor cavity 22. System provides the desired supplementary heat ventilation at a nose portion 18 forward of and adjacent to surface 14 of hull 15 of torpedo 10 and stabilizes gas/vapor cavity 22 by recirculating an aft portion of gas/vapor cavity 22, as described below. The rate of recirculation of gas/vapor cavity 22 is tuned to match the apparent speed of ambient water 8 as torpedo 10 makes its run through it. By matching the velocity of the recirculating gas/vapor cavity 22 to the velocity of ambient water 8 along a cavity interface boundary 25, cavity 22 will be stable.

FIG. 1 schematically shows system 20 of the invention on torpedo 10 as it progresses underway through ambient water 8 in gas/vapor cavity 22. A forward facing sonar array 16 of torpedo 10 is modified to include a central rigid support member 17 instead of a traditional center element, and support member 17 holds a cavitator plate 28 forward on torpedo 10. Cavitator plate 28 is typically dome shaped and produces cavitation vapor 33B.

Figure 3A:
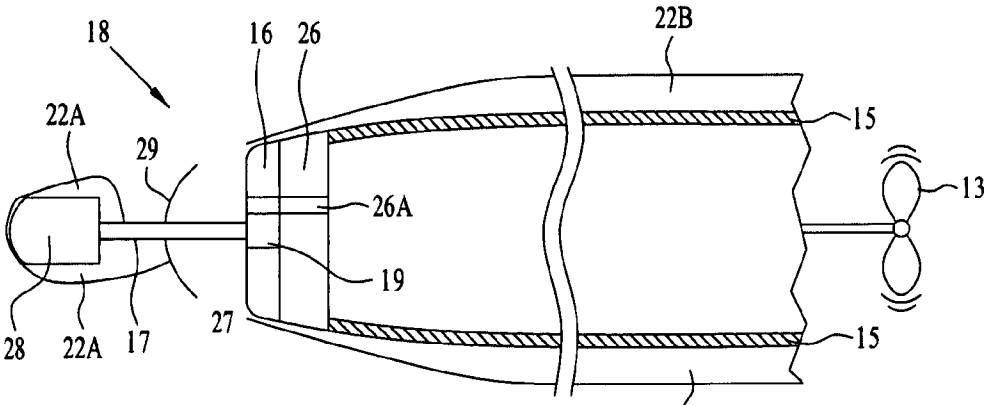
FIGS. 3A and 3B schematically respectively show creation of a cavity boundary interface.

Referring additionally to FIG. 3A, at low speed operation of torpedo 10, cavitator 28 would at best create only small, unstable cavities 22A that might only flutter in and out of existence behind cavitator 28 and in front of sonar array 16 at nose portion 18 of torpedo 10. In addition, at low speed operation other speculatively shown cavities 22B might be formed by cavitator 28 but these are likely to be so unstable or poorly defined as to be virtually nonexistent along hull 15 of torpedo 10. At low speeds, system 20 is not activated and torpedo 10 performs very much like a conventional torpedo during low speeds and does not produce cavities in front of sonar array 16; however, it may have increased sonar and homing capabilities.

Figure 3B:
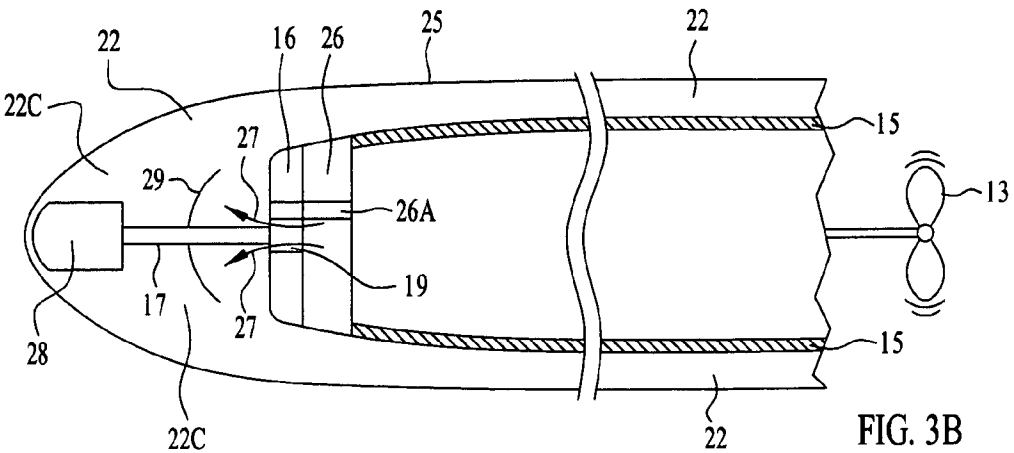

Referring also to FIG. 3B, at higher speeds, however, the dome shape of cavitator 28, venting of ventilation gas (as shown by arrows 27) from a source of ventilation gas 26, and other gas recirculation of system 20 to be described, cause torpedo 10 to be fully enveloped in a gas/vapor cavity 22. Gas/vapor cavity 22 extends radially outwardly from cavitator 28 and behind it over nose portion 18 and along outer surface 14 of hull 15.

Ventilation gas source 26 can include compressed gas cylinders, gas and/or steams generators, or other suitable source of readily available volumes of ventilation gas 27 for helping cavitator 28 create gas cavity 22. Small amounts of ventilation gas 27 can be selectably vented through an opening 19 that extends from gas source 26 through sonar array 16 in nose portion 18. A conical deflector 29 is mounted on support member 17 forward of sonar array 16 and gas source 26 and behind cavitator 28 to deflect the vented amounts of ventilation gas 27 and to minimize oscillations in a forward portion 22C of cavity 22 that is created behind cavitator 28 and in front of sonar array 16. Deflector 29 also deflects vented gas 27 radially outwardly to cover surface 14 along hull 15 with gas/vapor cavity 22.

FIG. 1 shows a pump 32 that can be mounted at aft end 34 of torpedo 10 to draw in some or a portion of the gas and vapor (shown as arrows 33A) of gas/vapor cavity 22. Pump 32 can be a ring-shaped structure uniformly drawing-in portion 33A of gas/vapor 33B in cavity 22 around aft end 34 of torpedo 10. Drawn-in portion 33A is pumped by pump 32 as recirculated gas (shown as arrows 33B) through at least one elongate insulated duct 36 to extension duct 26A through gas source 26 and sonar array 16 that communicates with forward portion 22C of cavity 22. From extension duct 26A recirculated gas/vapor 33B is vented to forward portion 22C of cavity 22 at nose portion 18 behind cavitator 28 and in front of sonar array 16. Drawn-in gas/vapor 33A is thereby recirculated as shown by arrows 33B from at least one insulated duct 36, over nose portion 18 and along surface 14 of hull 15 in gas/vapor cavity 22. Recirculated gas/vapor 33B can also include ventilation gas 27 from gas source 26 to maintain an effective and self-sustaining gas/vapor cavity 22 of sufficient thickness 23 on torpedo 10.

In addition to pumped, drawn-in gas 33A from cavity 22, some excess gas 33D can leak from cavity 22 at aft end 34 of torpedo 10; however, gas leakage 33D associated with system 20 is much less than that for other known supercavitating vehicles. This lesser amount of leakage 33D of system 20 is not a concern for torpedo runs of typical duration and range. The important considerations which are met by system 20 are that gas/vapor cavity 22 has a nearly uniform thickness 23 and velocity surrounding hull 15. The speed of pump 32 will impact the total mass flow and hence velocity of recirculated drawn-in gas within cavity 22. The speed of pump 32 is controlled by control unit 40 to assure that the velocity of recirculated gas 33B gas within cavity 22 nearly matches or is virtually is the same as the forward speed of the vehicle, but in the opposite direction. By selectively matching the velocities across interface boundary 25, gas/vapor cavity 22 will be stable for different forward speeds. This greatly enhances the stability of the interface boundary 25. The stable, fast moving gas/vapor along hull 15 and recirculated through duct 36 greatly reduces friction between hull 15 and ambient water 8 to enhance performance in terms of speed and range of torpedo 10.

In addition, system 20 can provide for minimization of loss of waste heat of torpedo 10 to further assure that gas/vapor cavity 22 can be continuously maintained over outer surface 14 of hull 15. A continuous heat shield or heat sink 30 is placed around engine 11. Heat shield-sink 30 collects and stores engine waste heat of engine 11 transfers it to hull 15 of torpedo 10 along the abutting juncture of high heat capacity layer 15A of hull 15 where layer 15A contacts heat shield-sink 30, see FIG. 2.

An independent auxiliary heating unit 31 additionally also can be located at a convenient position forward in torpedo 10 and next to hull 15. Auxiliary heating unit 31 will further assure an adequate supply of sufficient heat is transferred to maintain gas/vapor cavity 22. Heating unit 31 can be placed adjacent high heat capacity layer 15B of hull 15 and can combust a self-contained oxygenated fuel supply or could create additional heat in coils from an onboard electrical power source, for examples.

A computerized control unit 40 can be connected via leads 41 to pump 32, gas source 26, engine 11, independent auxiliary heating unit 31, as well as other control surfaces (not shown to avoid unnecessary complication). Control unit 40 also can be connected by leads 41A to temperature/pressure/thickness monitors 45 located at several different places in cavity 22, (only two monitors 45 are schematically depicted). Monitors 45 are provided to indicate whether cavity 22 is at the right temperature, pressure, and thickness to maintain cavity 22 for different speeds and depths of torpedo 10. Control unit 40 is connected to pump 32 to draw-in and recirculate greater or lesser amounts of recirculated gas/vapor 33B of cavity 22 in response to monitor 45. Control unit 40 is connected to gas source 26 to deliver appropriate, predetermined amounts or flow of gas 27 to cavity 22 at predetermined times in response to monitors 45. Control unit 40 can activate independent auxiliary heating unit 31 when more heat is needed to sustain cavity 22 in response to monitors 45. Control unit 40 also can be responsive to remotely originating acoustic or other control signals 42 to selectively activate these and/or other interconnected components as needed to successfully complete a mission.

In operation outer surface 14 of hull 15 of torpedo 10 would operate near ambient temperature of ambient water 8 as a result of forced convection along outer surface 14. At a desired time control unit 40 initiates ventilation gas source 26 to vent gas 27 through opening 19 behind conical deflector 29 and cavitator 28 to envelop torpedo 10 in an envelope of gas 27. As contact between liquid ambient water 8 and outer surface 14 of hull 15 is interrupted, the temperature within the gas envelop of cavity 22 on surface 14 rises rapidly since waste heat from engine 11 is being conducted through layers 15A, 15B, 15C and 15D. Meanwhile, internal components of torpedo 10 are shielded from the high temperature of the waste heat by insulating layer 15E.

When a desired heat flux rate is being transmitted from engine 11 to hull 15 via heat shield-sink 30, the amount of heat flowing into shell 15 allows heat to flow outward and forward along hull 15. When sufficient heat is produced by engine 11 alone, the use of auxiliary heating unit 31 would be curtailed, but if more heat were needed, then auxiliary heating unit 31 could be activated.

After the desired heat flux and temperature is created along surface 14 of hull 15 by engine 11 and heat shield-sink 30 and possibly auxiliary heating unit 31, the flow of gas 27 from ventilation gas source 26 can be shut off and cavity 22 will be self-sustaining. Thus, it is seen that ventilation gas 27 of ventilation gas source 26 was used to initiate cavity 22, and only relatively small amounts of ventilation gas 27 are required. In addition, system 20 of the invention is able to initiate and maintain gas/vapor cavity 22 without expending the excessive (and nearly overwhelming) amounts of heat energy otherwise needed to nucleate boiling from liquid water to gaseous vapor within cavity 22.

Heat transfer-ventilation system 20 of the invention provides for decreased drag and results in increased range and speed. System 20 permits the use of supercavitation at deep depths and can operate over multiple speed ranges during a single run to provide increased lethality of onboard ordnance. System 20 decreases the level of self-generated noise and hence increases the performance of the vehicle's sonar arrays.

Heat transfer-ventilation system 20 has the ability to create gas/vapor cavity 22 over an underwater vehicle, such as torpedo 10, and the ability to store large amounts of waste heat onboard torpedo 10 so that gas/vapor cavity can be efficiently and quickly created with a minimum amount of ventilation gas 27 during a torpedo run. System 20 has means to affect and control the stability of vapor cavity 22 at variable speeds. Heat transfer-ventilation system 20 can use supercavitation to control thermal properties of surface 14 of torpedo 10 and can cycle between gas/vapor cavities 22 that are recirculated at different speeds for low speed and high speed operation during a single torpedo run.

It is understood that heat transfer-ventilation system 20 could be made in accordance with this invention in different sizes and configurations for different undersea vehicles without departing from the scope of the invention herein described. System 20 having a means to create gas/vapor cavity 22 and then heating a surface to maintain cavity 22 could be adapted to any underwater and/or surface platform. Heat transfer-ventilation system 20 could be operated over a range of surface temperatures with or without waste heat from engine 11 and could be used with or without auxiliary heat source 31. System 20 could be used on a conventional, rocket or electric powered torpedo and could be operated with or with the recirculation of gas via pump 34. The design of heat transfer-ventilation system 20 in association with the shell and/or torpedo homing system of torpedo 10 as disclosed is not the only way, nor is the length and position of vapor cavity 22 on torpedo 10 the only configuration. Having this disclosure in mind, selection of suitable components from among many proven contemporary designs and compactly interfacing them as disclosed herein can be readily done without requiring anything beyond ordinary skill.

The components and their arrangements as disclosed herein all contribute to the novel features of this invention. Heat transfer-ventilation system 20 of this invention provides a reliable and cost-effective means to improve the efficiency of undersea vehicles, such as torpedo 10. Therefore, system 20 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system to create and maintain a cavity on the surface of an undersea vehicle comprising:

means for venting gas at a nose portion of the undersea vehicle, said vented gas initially creating a cavity enveloping a nose portion and an adjacent outer hull of the undersea vehicle;

a heat source within the undersea vehicle;

means for transferring heat positioned to transfer heat from said heat source to the outer hull of the undersea vehicle for raising the temperature of the outer hull; and means for recirculating a portion of said vented gas within the cavity as recirculated gas, said recirculating means transferring the portion of said vented gas to the nose portion from an aft end of the undersea vehicle.

2. The system of claim 1 wherein said recirculating means is capable of controlling the velocity of said recirculated portion of said vented gas to be virtually the same as the relative flow rate of ambient water as the undersea vehicle travels through the ambient water.

3. The system of claim 2 wherein said velocity of said recirculated portion of said vented gas maintains the stability of said cavity.

4. The system of claim 1 further comprising:

a cavitator located forward of said gas venting means on the undersea vehicle;

a deflector located behind said cavitator, said deflector being capable of radially deflecting said vented gas.

5. The system of claim 4 wherein said gas venting means includes a source of pressurized gas.

6. The system of claim 5 wherein said recirculating means includes a pump connected to an insulated duct.

7. The system of claim 6 further comprising:

a control unit connected to said pump;

temperature sensors positioned on the outer hull; and flow sensors positioned on the outer hull, said control unit being connected to said temperature sensors and flow sensors.

8. The system of claim 7 wherein said control unit is connected to control said source of pressurized gas and said heat source.

9. The system of claim 1 wherein said heat transferring means includes a heat sink in contact with said heat source to collect heat from said heat source and transfer heat to the outer hull.

10. The system of claim 9 wherein said heat source is a thermal engine having waste heat.

11. The system of claim 10 wherein said heat transferring means further comprises an auxiliary heating unit in the undersea vehicle to assure an adequate supply of heat.

12. An undersea vehicle comprising:

a hull having a nose portion, an outer hull, and an aft portion;

means for venting gas positioned to vent gas at said nose portion of said hull;

a thermal engine within said hull;

means for transferring heat positioned to receive heat from said thermal engine and to transfer heat to the outer hull; and means for recirculating vented gas positioned in said hull to receive gas at the aft portion of said hull and to transfer said received gas to said means for venting gas.

13. The vehicle of claim 12 further comprising:

a cavitator located forward of said gas venting means on said nose portion of said hull; and a deflector located behind said cavitator for radially deflecting said vented gas.

14. The vehicle of claim 13 wherein said heat transferring means further comprises an auxiliary heating unit in said hull to assure an adequate supply of heat.

15. The vehicle of claim 13 wherein said recirculating means includes a pump connected to an insulated duct, and further comprising:

a control unit connected to said pump;

temperature sensors positioned on the outer hull; and flow sensors positioned on the outer hull, said control unit being connected to said temperature sensors and flow sensors.

16. The vehicle of claim 15 wherein said heat transferring means further comprises an auxiliary heating unit in said hull, said control unit being connected to control said auxiliary heating unit.

17. The vehicle of claim 15 wherein said control unit is capable of controlling the pump so that the velocity of said recirculated portion of said vented gas is substantially the same as the relative flow rate of ambient water as the undersea vehicle travels through the ambient water.

* * * * *